US011549338B2

(12) United States Patent
Alhalabi

(10) Patent No.: US 11,549,338 B2
(45) Date of Patent: Jan. 10, 2023

(54) APPARATUS FOR CLEARING A PLUGGED CONTROL LINE

(71) Applicant: Abu Dhabi National Oil Company, Abu Dhabi (AE)

(72) Inventor: Abdallah Sobhi Alhalabi, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 0 days.

(21) Appl. No.: 16/977,125

(22) PCT Filed: Feb. 21, 2019

(86) PCT No.: PCT/IB2019/051420

§ 371 (c)(1),
(2) Date: Sep. 1, 2020

(87) PCT Pub. No.: WO2020/170010

PCT Pub. Date: Aug. 27, 2020

(65) Prior Publication Data

US 2021/0002984 A1 Jan. 7, 2021

(51) Int. Cl.

| | |
|---|---|
| ***E21B 41/00*** | (2006.01) |
| ***B08B 9/032*** | (2006.01) |
| ***E21B 34/10*** | (2006.01) |

(52) U.S. Cl.

CPC ..... *E21B 41/00* (2013.01); *B08B 9/0321* (2013.01); *B08B 2209/032* (2013.01); *E21B 34/10* (2013.01)

(58) Field of Classification Search

CPC ..... E21B 34/10; E21B 37/06; E21B 41/00; B08B 2209/032; B08B 9/0321

See application file for complete search history.

(56) References Cited

U.S. PATENT DOCUMENTS

| | | | |
|---|---|---|---|
| 4,480,687 | A | 11/1984 | Terral |
| 7,198,099 | B2 | 4/2007 | Lugtmeier et al. |

(Continued)

FOREIGN PATENT DOCUMENTS

| | | | |
|---|---|---|---|
| CN | 108643858 | A | 10/2018 |
| GB | 2535186 | A | 8/2016 |

(Continued)

OTHER PUBLICATIONS

International Search Report and Written Opinion for corresponding International Patent Application No. PCT/IB2019/051420 dated Jun. 4, 2019.

(Continued)

*Primary Examiner* — Daniel P Stephenson

(74) *Attorney, Agent, or Firm* — Renner, Otto, Boisselle & Sklar, LLP

(57) ABSTRACT

The present invention relates to an apparatus (20) for clearing a plugged control line (12), in particular for clearing a plugged surface controlled sub-surface safety valve (11) control line (12), the apparatus (20) comprising a connecting means (27) configured to connect the apparatus (20) to an upstream end of the plugged control line (12); and a pumping means (21, 22) configured to pump a dissolvent (30) through the connecting means (27) into the control line (12) to build up dissolvent pressure in the control line (12). The invention further comprises a bore system and a method for clearing a plugged control line (12).

19 Claims, 1 Drawing Sheet

(56) References Cited

U.S. PATENT DOCUMENTS

| | | | | |
|---|---|---|---|---|
| 9,447,658 | B2 | 9/2016 | He et al. | |
| 2009/0205831 | A1 | 8/2009 | Jacob | |
| 2009/0205832 | A1 | 8/2009 | Jean-Luc | |
| 2015/0298179 | A1* | 10/2015 | Suematsu | B08B 9/032 134/100.1 |
| 2016/0053574 | A1 | 2/2016 | Miller et al. | |
| 2021/0002984 | A1* | 1/2021 | Alhalabi | E21B 41/00 |

FOREIGN PATENT DOCUMENTS

| | | | |
|---|---|---|---|
| WO | 2005/045183 | A1 | 5/2005 |
| WO | 2007129234 | A1 | 11/2007 |

OTHER PUBLICATIONS

Indian and English Version of Indian Examination Report issued for corresponding Indian Application No. 202047039340, dated Sep. 29, 2021.

English Translation of Chinese First Office Action issued for corresponding Chinese Application No. 201980009263.X, dated Jan. 4, 2022.

* cited by examiner

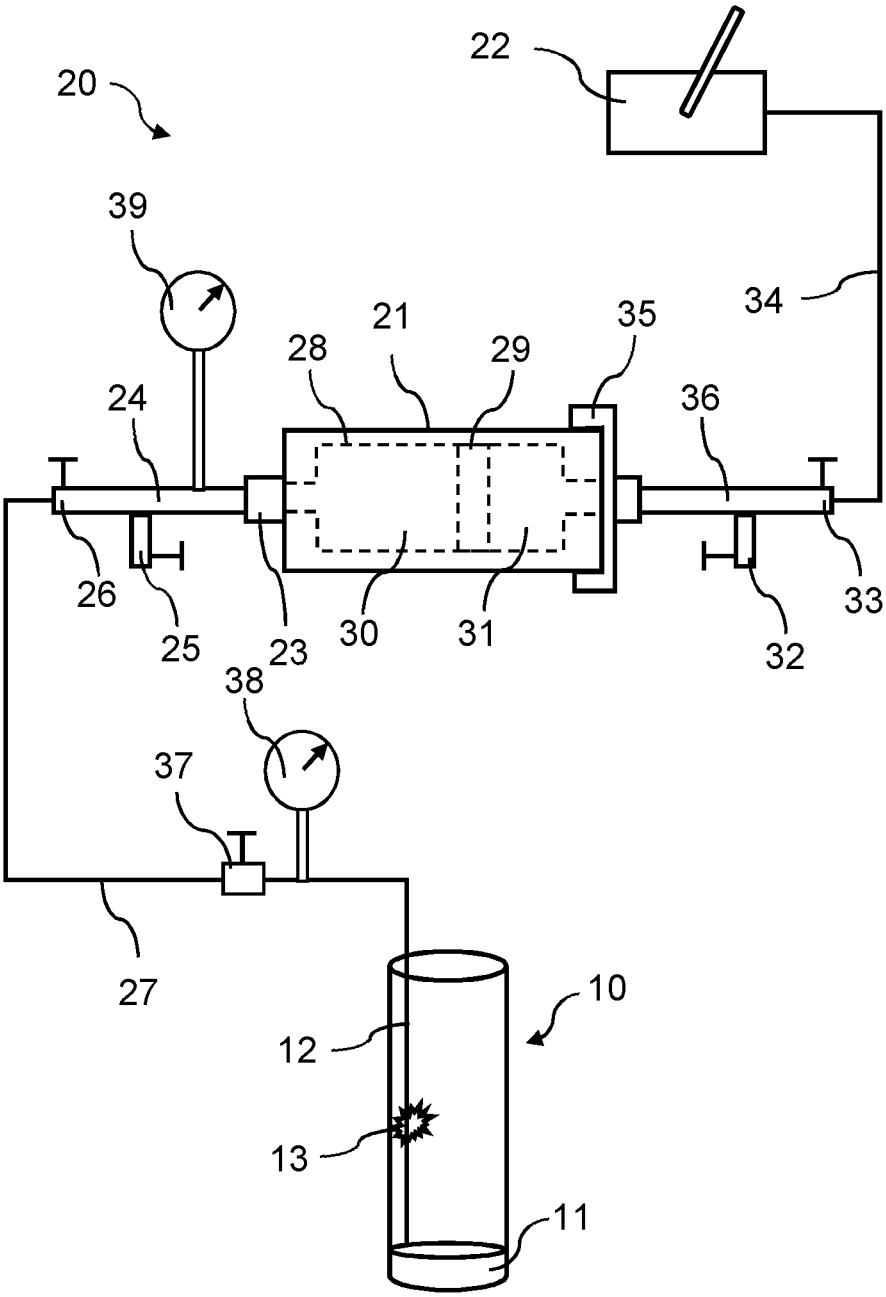
20
22
39
34
21
35
28
29
24
36
26
25
23
30
31
32
33
38
37
27
10
12
13
11

APPARATUS FOR CLEARING A PLUGGED CONTROL LINE

FIELD OF THE INVENTION

The present invention relates to an apparatus for clearing a plugged control line. The invention further relates to a bore system comprising such an apparatus, as well as a method for clearing a plugged control line.

TECHNICAL BACKGROUND

A surface-controlled sub-surface safety valve (SCSSSV) is a device which is commonly used to shut in oil and gas wells. In general, a sub-surface safety valve (SSSV) may be installed in an upper wellbore to provide an emergency closure of the producing conduits in the event of an emergency. It may be surface-controlled or subsurface-controlled, and is designed to be fail-safe, so that the wellbore is isolated in the event of any system failure or damage to the surface production-control facilities.

A SCSSSV is a downhole safety valve (DSV) that is operated from surface facilities through a control line, which may be strapped to an external surface of a tubing. Such a DSV is a fail-safe device that is held open by means of pressure (or hydraulic control pressure) transmitted through the control line. In normal operation, the control line remains pressurized, keeping the safety valve (e.g. a ball or flapper assembly of the valve) in the open position. If loss of control line pressure occurs, for example due to a leak or due to a respective control by an operator, the safety valve will close. Thereby, the well bore can be isolated from the surface production-control facilities.

Leakage or plugging of the control line can lead to reduced functionality of the DSV, which in turn effects the overall well integrity and safety. Loss of control of the DSV can create an unsafe operating condition, as in this situation the wellbore cannot be isolated from the surface production-control facilities in the event of any system failure. This in turn can cause a significant safety, environmental and capital risk.

Several techniques for clearing control lines in wells are known. Prior art document WO 2007/129237 A1, for example, suggests removing the safety valve from a nipple of a wellbore production tubing, setting into the nipple a sealing tool which sealingly connects the control line and providing a mini tubing running down into the production tubing, and increasing the pressure of a fluid into the mini tubing to cause fluid to flow into the control line through the sealing tool. According to this prior art technique, the blockage is pushed upwardly through the control line, thus reversing the fluid pressure applied with the control line that would usually maintain the valve in its open position. By then releasing the pressure applied to the control line, the blockage can be moved, disintegrated and ejected from the control line.

Document US 2009/0205832 A1 similarly suggests acting against any blockage or clogging by providing a solvent to the back of any blockage in the control line. According to a control line clearing method disclosed therein, a sleeve is deployed into a first internal passage of a downhole element, and fluid communication between a control port on the downhole element to which a control line is connected and the annulus between the sleeve and the first internal passage is sealably separated. Further, fluid communication between a feed line disposed in a second internal passage of the sleeve and the control port of the downhole element is established, and a first fluid from the feed line to the control port of the downhole element is applied.

These prior art solutions restrict the flow inner diameter of the tubing, as further lines up provided within the tubing. Additional adaptors have to be fabricated and installed with existing wellheads to accommodate the additional elements. Further, these prior art techniques require special installation packages and specially trained experts. As the conventional solutions typically take several weeks, and require a shutdown prior to the work, these prior art solutions drastically reduce the well production and come along with high costs.

Thus, and is an object of the present invention to overcome the above drawbacks at least partially. It is thereby a particular object of the present invention to provide a technique for clearing a plugged control line with low effort and at low costs.

These and other objects, which become apparent to the person skilled in the art from the following description, are solved by the subject matter of the independent claims. Preferred embodiments are set out in the dependent claims.

SUMMARY OF THE INVENTION

The present invention relates to an apparatus for clearing a plugged control line. The control line may thereby be used to operate downhole completion equipment, such as for example a DSV, a SSSV, or a SCSSSV. As will be appreciated by the person skilled in the art, this control line may be plugged, whereby the control function of the control line may be impaired at least partially. The plugging may result from plugging material accumulating at one or more areas in the control line, thereby locally reducing or even preventing flow through the control line. By means of the apparatus according to the present invention, the plugging of the control line may be cleared at least partially. Preferably, the apparatus may allow for completely clearing a plugging of a plugged control line, thereby restoring full functionality of the control line.

The apparatus comprises a connecting means configured to connect the apparatus to an upstream end of the plugged control line. Thus, the apparatus must not necessarily be connected to an end of the control line proximate to the downhole equipment, for example the downhole safety valve, but may be connected to the control line at or close to the surface. Preferably, the apparatus may be connected by means of the connecting means to a control line port, preferably at the wellhead side of the well. Contrary to prior art techniques, the connection is not provided at a downhole side of the control line, i.e. downhole of the plugging.

The apparatus further comprises a pumping means configured to pump a dissolvent through the connecting means into the control line to build up dissolvent pressure in the control line. Thus, the pumping means may be connected to the control line via the connecting means, so that the dissolvent can be injected into the upstream end of the control line. By building up a dissolvent pressure in the control line by means of the pumping means, the dissolvent is urged to reach the plugging area in the control line and can interact or chemically react with the plugging material in order to dissolve the plugging.

The present invention thus provides for an easy way of clearing a plugged control line. In the event of plugging, the apparatus has to be connected to the upstream end of the control line, which can be accessed in an easy manner. Then the dissolvent is pumped into the control line at a suitable high pressure, so that pressurized dissolvent is provided at the plugging. Any disassembly of the well bore, for example to introduce further lines to reach a downstream end of the control line, is advantageously not required. No extensive resources for clearing the control line are required, particularly with regard to planning, mobilization and execution. The apparatus has a simple design and requires only few components, which can be set up and operated in an easy manner in a short time, without the need of any major site preparation. With the apparatus, SCSSSV functionality can be restored in a short time (minutes to a few days), so that only little production loss occurs. As the apparatus can be manufactured and operated at comparably low cost, an economical mean to solving the problem of control line plugging is provided.

With regard to the dissolvent, the person skilled in the art understands to choose a suitable chemical or compositions thereof. Depending on the source of the plugging, which may be identified based on the well production's sample analysis done earlier in the laboratory, a respective adequate dissolvent can be used. In a preferred embodiment the dissolvent comprises a corrosive substance. Thus, the dissolvent may be any chemical that will dissolve the structure of an object, and can thus comprise acids, oxidizers, organic solvents, or bases. When such substances come in contact with plugging material, the plugging material deteriorates. Preferably, the dissolvent comprises an acid. By means of the acid, the plugging can be attacked and cleared in an efficient and fast manner. Due to the dissolvent pressure built up by means of the pumping means, the acid can continuously attack the plugging to eventually clear it. Further preferred, the acid is a mineral acid, and further preferred a strong acid, such as hydrofluoric, sulfuric or nitric acid. Hydrofluoric acid allows for efficiently clearing any plugging in short time.

In a particularly preferred embodiment, the concentration of the acid is in the range of 0,1-60%, further preferred in the range of 1-50%, further preferred in the range of 10-45%, further preferred in the range of 20-30%, and most preferred in the range of 25-28%. Thus, it is preferred to use a concentration of the acid high enough to efficiently attack the plugging, and low enough to preserve the apparatus and control line, as will be appreciated by the person skilled in the art. The selection of the dissolvent is preferably based on the earlier laboratory's analysis done to the production's sample in order to identify the plugging material (sand, metal debris, asphaltene, etc.) and thus to select the suitable solvent. The person skilled in the art understands to choose suitable materials for the connecting means and pumping means in order to handle the respective dissolvent.

Preferably, the connecting means comprises an autoclave fitting, which may allow for handling high pressures and/or corrosive substances with a metal to metal sealing feature. By means of this autoclave fitting, the apparatus can be connected to the control line in a safe manner, ensuring an overall safe use of the apparatus.

Preferably, the connecting means comprises a valve configured to control the flow of the dissolvent between the apparatus and the control line. It is thereby actuatable to isolate the control line from the apparatus after having built up pressure in the control line by means of the pumping means. Thus, while the pressurized dissolvent reacts with the plugging, the valve can be closed to then be able to reduce the pressure in the apparatus itself while the reaction in the control line takes place to clear the plugging. This also allows re-filling of dissolvent into the apparatus.

Preferably, the pumping means is configured to build up dissolvent pressure in the control line in the range of 3,4-34,5 MPa, further preferred in the range of 3,4-27.6 MPa, further preferred in the range of 3,4-20.7 MPa, further preferred in the range of 6,9-20.7 MPa, and most preferred in the range of 6,9-13.8 MPa. Thus, rather high pressures can be provided, so that the plugging can be attacked by the dissolvent in an efficient manner, allowing for a fast clearing of the plugging. It is preferred to build up the pressure gradually when performing repeating attempts to clear the plugging.

Preferably, the pumping means comprises a dissolvent pump, which is preferably an acid pump. The pump may comprise a respective intake or storage for receiving the dissolvent to be pumped into the control line.

Preferably, the dissolvent pump comprises a cylinder and a piston, movable within the cylinder for separating dissolvent from hydraulic fluid. The person skilled in the art understands that respective components of such a pump may be made of such material which can sustain the respective dissolvent or acid. Further preferred, the pumping means comprises a hand operated pump connected to the dissolvent pump and configured to hydraulically operate the dissolvent pump. Thus, the hand operated pump can be a commonly available hydraulic pump. Thus, the hydraulic pump which is directly engaged by the operator is separated from the dissolvent pump containing the dissolvent. Therefore, the hand operated pump can be free of the dissolvent or acid. This increases safety, particularly if an acid is used as dissolvent. Upon operation, the operator operates the hand operated hydraulic pump, which builds up an operating hydraulic pressure for operating the dissolvent pump by urging the piston within the cylinder of the dissolvent pump for pumping dissolvent into the control line. This provision of two separate pumps thus improves the safety as in the event of any leak in the dissolvent pump or in the connecting means, exposure of the operator to any hazardous substances can be avoided.

Preferably, all components of the apparatus coming into contact with the dissolvent are made from corrosion resistant alloys. Preferably, the dissolvent pump and/or the connecting means comprises or essentially consists of steel, preferably carbon steel. Preferably, the dissolvent-contacting components of the dissolvent pump and/or the connecting means comprises or essentially consists of a Carbon steel base material cladded by Nickel alloy, preferably by Inconel 625 or it may be completely manufactured of Nickel alloy material, preferably of Inconel 718. These materials allow for the pump to sustain the high pressures and the dissolvent, especially if corrosive substances are used. Thus, a low-grade Carbon steel material can be used, which is cladded by Nickel alloy for improving corrosion resistance. Alternatively, the dissolvent-contacting components of the dissolvent pump can be integrally made of a high-grade Nickel alloy material, preferably of Inconel 718. Preferably, the apparatus comprises seals of hydrogenated neutral butadiene rubber. These seals are particularly suitable when using acids.

Preferably, the pumping means provides for a dual stroke pumping functionality. Thus, not only can the dissolvent be pumped into the control line by means of the pumping means, but can also be sucked out of the control line. Thus, after the dissolvent reacted with the plugging material at least partially, it can be partially sucked out of the control line together with the dissolved plugging material or completely sucked out in the case of plugging material took a near place to the surface outlet. Afterwards, dissolvent can again be pumped into the control line to further react with the remaining plugging material. By analyzing the extracted material, the operator can make conclusions on the source of the plugging. This dual stroke functionality is used to clear the control line from dissolvent after the plugging is released and prior to filling it with new operating fluid for the SCSSSV. Further, a reverse force can be created by the dual stroke's sucking power, which allows a turnover or moving up the dissolved plugging material and replace it by the fresh injected dissolvent to be in contact with the remaining plugging material and continue chemical reaction with the same. In addition to the dual acting strokes can be used to apply two different opposite forces, namely pumping and sucking forces, at the plugging material surface to effectively increase the chances of cracking or breaking the plugging material and of clearing control line.

The present invention further relates to a bore system comprising a tubing, a safety valve located in the tubing, a control line connected with the safety valve for controlling the safety valve, and an apparatus according to the above connected to an upstream end of the control line. Preferably only a single control line is provided for the safety valve. Preferably, the safety valve is a surface controlled subsurface safety valve (SCSSSV).

The present invention further relates to a method for clearing a plugged control line, preferably by using an apparatus according to the above. The method thereby comprises the step of pumping a dissolvent into an upstream end of the control line to build up dissolvent pressure in the control line. As detailed above, a chemical reaction between the dissolvent and the plugging material can then take place, for clearing the control line. As detailed above, the dissolvent may comprise acid according to a preferred embodiment of the invention.

Preferably, the method further comprises, after the step of pumping, the step of releasing dissolvent pressure in the control line at least partially after expiry of a time period. Thus, dissolvent pressure is upheld in the control line for a certain amount of time, allowing for the dissolvent to react with the plugging material. Afterwards, dissolvent pressure is released. Further preferred, the steps of pumping dissolvent into the control line and releasing dissolvent pressure are repeated one or more times. Thus, in an alternating manner, the dissolvent may be pumped into the control line, may be kept in there at elevated pressure for a certain amount of time, before the dissolvent pressure may be released and the dissolvent may be extracted at least partially. Then, again, the dissolvent may be pumped into the control line, kept there at elevated pressure for a certain amount of time, and then dissolvent pressure may be released. This allows for stepwise loosening and extracting the plugging material from the control line, which provides for an efficient clearing of the control line.

Preferably, with at least two repetitions, the dissolvent pressure built up in the control line during pumping is increased. Thus, with each step of pumping dissolvent into the control line, a higher pressure may be built up in the control line. For example, during a first step of pumping dissolvent into the control line, a dissolvent pressure of 6,89 MPa may be built up. When pumping dissolvent into the control line for a second time, a dissolvent pressure of 10.34 MPa may be built up.

Preferably, the first two to four pumping attempts can have a short waiting time period due to the purpose of these starting attempts to allow mixing or replacing the existing hydraulic oil inside the control line above the plugging material with the injected dissolvent in order to establish the chemical reaction with the plugging material. The following injecting attempts can have a longer soaking time period to allow longer and effective chemical reaction.

Preferably, with at least two repetitions, the time period waited for before releasing pressure is increased. Thus, for example, after having pumped dissolvent into the control line for the first time, the operator may wait for 10 minutes before releasing dissolvent pressure. After having pumped dissolvent into the control line for a second time, preferably at a higher pressure, the operator may wait for a longer period of 20 minutes before releasing dissolvent pressure. This increase soaking time period allows for efficiently dissolving the plugging material.

In a preferred embodiment, the step of pumping is performed to build up a first dissolvent pressure in the control line, and the method further comprises, after the step of pumping, waiting for a first time period, wherein the first time period is preferably in the range of 1-30 minutes, and releasing the first dissolvent pressure in the control line at least partially after expiry of the first time period. Further preferred, the method further comprises, after the step of releasing the first pressure, pumping dissolvent into the control line to build up a second dissolvent pressure in the control line, wherein the second pressure is higher than the first pressure, waiting for a second time period, wherein the second time period is longer than the first time period, and releasing the second dissolvent pressure in the control line at least partially after expiry of the second time period. This procedure may be repeated with increasing time periods and/or increased pressures, as will be appreciated by the person skilled in the art. Thereby, the plugging can be cleared in an efficient manner.

Preferably, the method further comprises, after pumping dissolvent into the control line, extracting the dissolvent from the control line. Thereby, the dissolvent may be partially sucked out of the control line together with dissolved plugging material, preferably by means of a dual stroke pump. Clearing more volume allows injecting of or refilling with fresh dissolvent into the control line.

In a further preferred embodiment, the pumping is performed by means of a pump, and the method further comprises closing a valve located between the pump and the control line during at least part of the time period, and releasing pressure in the pump while maintaining the pressure in the control line. By releasing pressure in the pump while maintaining the pressure in the control line, the pump is protected against wear and/or corrosion.

In a further preferred embodiment, the step of pumping dissolvent into the control line comprises actuating a hydraulic pump, wherein the hydraulic pump hydraulically actuates a dissolvent pump for pumping dissolvent from the dissolvent pump into the control line. The hydraulic pump is preferably a hand operated hydraulic pump that provides hydraulic fluid under a high pressure. Thus, an operator only has to operate the hydraulic pump, which is be free of any dissolvent. This increases safety of operation.

Preferably, the dissolvent pump comprises a cylinder and a piston, movable within the cylinder, for separating dissolvent from hydraulic fluid.

The person skilled in the art understands that the details provided above with regard to the apparatus similarly apply to the method. Thus, the dissolvent may comprise a corrosive substance, and may preferably comprise hydrofluoric acid and high concentration. By pumping dissolvent into the control line, dissolvent pressure can be built up in the control line in the range of 6,89-48,3 MPa, further preferred in the range of 13,8-44,8 MPa, further preferred in the range of 20,7-41.4 MPa, further preferred in the range of 27,6-37.9 MPa, and most preferred in the range of 31,8-34.5 MPa.

According to the inventive method, the clearing of the plugged control line may require a time period between 30 minutes and 5 days, preferably between 30 minutes and 2 days, most preferably between 1 hour and 1 day. Thus, compared to other prior art techniques, a plugged control line can be cleared in a rather fast manner.

BRIEF DESCRIPTION OF THE DRAWINGS

In the following, a preferred embodiment of the invention is described with reference to the enclosed FIGURE. In which shows:

FIG. 1 a schematic illustration of a system including an apparatus for clearing a plugged control line according to an embodiment of the present invention.

DESCRIPTION OF THE PREFERRED EMBODIMENTS

According to the embodiment illustrated in FIG. 1, a tubing 10 of a well or wellhead is provided, which may extend from the surface level into the ground. The tubing 10 can be part of a petrochemical well for the production of oil and gas. The tubing 10 is provided with a surface-controlled sub-surface safety valve (SCSSSV) ii that can stop fluid flow in case of emergency. The SCSSSV 11 is hydraulically controlled by means of a control line 12. As will be appreciated by the person skilled in the art, the control line 12 at operating pressure holds the SCSSSV 11 in the open position, and when hydraulic pressure in the control line 12 drops, the SCSSSV 11 closes. The control line 11 may become plugged, as indicated with reference sign 13. This plugging 13 may compromise the overall functionality of the SCSSSV 11 and needs to be cleared.

In order to clear the plugging 13, an apparatus 20 is connected to the control line 12 via a connecting means 27. The connecting means 27 comprises some flexible high pressure and acid-resistant pipes and fittings for the connection to the upstream end of the control line 12, preferably a piece of Inconel control line may be used. The upstream end of the control line 12 is upstream to the plugging 13 and at surface level.

The apparatus 20 further comprises a pumping means 21, 22 for pumping a dissolvent 30 through the connecting means 27 into the control line 12 to build up dissolvent pressure within the plugged control line. The pumping means 21, 22 comprises an acid pump 21 which is configured to pump an acid into the control line 12 to build up acid pressure in the control line 12. The acid pump 21 is operated by hydraulic fluid 31 provided by a manually operated hydraulic pump 22.

The acid pump 21 comprises a cylinder 28 and a piston 29, which is movable within the piston and separates dissolvent 30, shown in FIG. 1 on the left side of the piston 29, from hydraulic fluid 31, shown in FIG. 1 on the right side of the piston 29.

The cylinder 28 of the acid pump 21 are preferably made of 4130 Carbone steel base material with Inconel 625 cladded inner diameter. The cylindrical piston 29 of the acid pump 21 is made of Inconel 718 base material and 2 hydrogenated nitrile butadiene rubber elastomeric seals at the outer diameter. The acid pump 21 further comprises a cap 35 for opening the acid pump 21 preferably at the hydraulic fluid side of the acid pump 21. The cap 35 is preferably screwed to cylinder 28 and allows for re-filling dissolvent 30 into the acid pump 21. The cap 35 is preferably made of 4130 Carbone steel base material with an internal ACME thread.

The acid pump 21 is connected to the control line 12 by means of the connecting means 27. The connecting means 27 further comprises an autoclave fitting 23, which allows for an easy and safe connection to the cylinder 28, a manifold 24, which includes a pressure relief needle valve 25 and control valves 26 and 37. A pressure gauge 39 may be also provided on the manifold 24 and a pressure gauge 28 may be provided between the control valve 37 and the control line 12. By the pressure relief needle valve 25 dissolvent 30 can be released from the apparatus 20. By the control valve 26 or 37 the dissolvent end of the acid pump 21 can be separated or isolated from the tube of the connecting means 27.

The apparatus 20 further comprises a hand operated hydraulic pump 22, which is connected to the acid pump 21 by a flexible high-pressure tubing 34 and by means of an autoclave fitting and a manifold 36 with a pressure relief needle valve 32 and a control valve 33. By actuating the hydraulic hand pump 22, hydraulic fluid 31 is pumped into the cylinder 28 of the acid pump 21 and the piston 29 of the acid pump 21 is moved, in order to inject acid 30, or another dissolvent 30, from the acid pump 21 into the control line 12. Due to this separation of hydraulic pressure generation by the hydraulic pump 22 and high-pressure dissolvent provision by the acid pump 21 security is increased for the operator and the costs for the apparatus 20 can be decreased as a commonly available hydraulic pump 22 can be used, which does not need to be acid resistant.

The acid pump 21 is configured to inject a high concentration acid 30, e.g. 28% HCl, at low flow rates and with a small volume into the control line 12, in order to dissolve the plugging 13 in the control line 12. The acid pump 21 is thereby filled with the acid 30. All connections between the acid pump 21 and the control line 12 are rated to a working pressure of 34,5 MPa or higher. By injecting the acid 30 into the control line 12 at elevated pressure, the fluid present in the control line 12 is flushed and direct contact between the acid 30 and the plugging material 13 can be established. Then, a chemical reaction between acid 30 and plugging material can take place in order to dissolve the plugging 13. Depending on the amount of plugging material, a soaking step may be performed.

All connections between the acid pump 21 and the control line 12 are made of corrosion resistant alloys, as are the components of the acid pump 21 coming in contact with the acid. This further improves safe operation.

The apparatus 20 also provide for a dual stroke pump functionality, capable of sucking plugging material from the control line 12, in addition to pumping acid 30 into the control line 12. Thereby, the acid 30 may be pumped into the control line 12, and after reacting with the plugging 13, the acid 30 and dissolved plugging material may be completely extracted in the case of the plugging material occurred at near point from surface (control line 12 outlet) but may be at least turnover, mixed or preferably replaced by the injected acid to be in contact with remaining plugging material.

According to a preferred embodiment, the following method is carried out to clear a plugged control line. In the first step, pressure in the control line 12 is released. Next, the acid pump 21 of the apparatus 20 is connected to the control line 12 via the connecting means 27. In a further step, the acid pump 21 is filled with the acid 30, and the hydraulic hand pump 22 is connected to the acid pump 21 via the hydraulic line 34. Afterwards, the control valve 26 between the control line 12 and the acid pump 21 is opened, as well as any further valves, e.g. control valve 33, between the hydraulic hand pump 22 and the acid pump 21.

Next, the hydraulic hand pump 22 is actuated by an operator. Thereby, the acid pump 21 is operated to build up acid pressure in the control line 12 by pumping hydraulic fluid 31 into the acid pump 21 and then acid 30 into the control line 12. In an initial pumping step, an acid pressure of 6,89 MPa may be built up, before the control valve 26 is closed. To reduce wear of the apparatus 20, hydraulic and acid pressure in the pumps 21, 22 may be released, for example by opening the pressure relief needle valve 25 or pressure relieve needle valve 32. After waiting for 5-10 minutes, the dissolvent pressure in the control line 12 may is released, for example by means of the control valve 26 and pressure relief needle valve 25. These steps are then repeated 3-5 times or more depends on the plugging material response to the chemical reaction.

Afterwards, the steps of pumping acid 30 into the control line 12 and keeping the control line 12 pressurized with the acid are repeated, wherein the pressure built up in the control line 12 is increased to 10.3 MPa and the waiting period before releasing pressure is extended to 20 minutes. With these adjusted parameters, 3-5 repetitions are performed.

Afterwards, the pressure and waiting period may again be increased, as will be appreciated by the person skilled in the art. The operator may measure and analyze the return from the control line 12 when releasing pressure, to check whether the plugging 13 is dissolving.

Once all plugging material inside the control line 12 is dissolved, the hand pump 22 may be operated reverse for pumping hydraulic fluid 31 out of the acid pump 21 and for pumping acid out of the control line 12 or may be flushed out to the other bottom end point of the control line 12 at the SSSCV landing nipple.

Preferably, the SSSCV 11 can be pulled out or removed from place in the landing nipple while performing the above steps in order to allow pushing plugging material outside the control line 12 end after it is released. Alternatively, the SSSCV limn be removed and reset during performing of the above-mentioned steps in order to allow attempting to flush control line 12 and check or confirm the release status of the plugging material.

Finally, the control line 12 is connected to an oil pump and flushed with new hydraulic oil. Preferably, the hydraulic hand pump 22 can directly connected to the control line 12 via the connecting means 27 for flushing the control line 12 with oil.

In this manner, the plugging 13 and the control line 12 can be cleared in a short time taking from only minutes or hours up to only several days, depending on the plugging material volume and dissolvent suitability and concentration.

The invention claimed is:

1. An apparatus for clearing a plugged control line, in particular for clearing a plugged surface controlled sub-surface safety valve control line, the apparatus comprising:

a. a connecting means configured to connect the apparatus to an upstream end of the plugged control line; and b. a pumping means configured to pump a dissolvent through the connecting means into the control line to build up dissolvent pressure in the control line.

2. The apparatus of claim 1, wherein the dissolvent comprises a corrosive substance.

3. The apparatus of claim 1, wherein the connecting means comprises an autoclave fitting.

4. The apparatus of claim 1, wherein the connecting means comprises a valve configured to control the flow of the dissolvent between the apparatus and the control line.

5. The apparatus of claim 1, wherein the pumping means is configured to build up dissolvent pressure in the control line in the range of 3.4-34.5 MPa.

6. The apparatus of claim 1, wherein the pumping means comprises a dissolvent pump.

7. The apparatus of claim 6, wherein the pumping means comprises a hand operated hydraulic pump connected to the dissolvent pump and configured to operate the dissolvent pump via a hydraulic fluid.

8. The apparatus of claim 6, wherein the dissolvent-contacting components of the dissolvent pump comprises or essentially consists of a. steel; or b. a Carbone steel base material cladded with Inconel 625; or c. a nickel base alloy; or d. all components of the dissolvent pump are manufactured of Inconel 718.

9. The apparatus of claim 6, wherein the dissolvent pump comprises a cylinder and a piston, movable within the cylinder, for separating dissolvent from hydraulic fluid.

10. The apparatus of claim 1, wherein the pumping means provides for dual stroke pumping functionality.

11. A bore system, comprising:

a. a tubing;

b. a safety valve, in particular a surface controlled sub-surface safety valve, located in the tubing;

c. a control line connected to the safety valve for controlling the safety valve; and d. an apparatus according to claim 1 connected to an upstream end of the control line.

12. The apparatus of claim 1, wherein the dissolvent comprises an acid.

13. The apparatus of claim 1, wherein the dissolvent comprises a mineral acid.

14. The apparatus of claim 1, wherein the dissolvent comprises a hydrofluoric acid.

15. The apparatus of claim 1, wherein the pumping means is configured to build up dissolvent pressure in the control line in the range of 3.4-27.6 MPa.

16. The apparatus of claim 1, wherein the pumping means is configured to build up dissolvent pressure in the control line in the range of 3.4-20.7 MPa.

17. The apparatus of claim 1, wherein the pumping means is configured to build up dissolvent pressure in the control line in the range of 6.9-20.7 MPa.

18. The apparatus of claim 1, wherein the pumping means is configured to build up dissolvent pressure in the control line in the range of 6.9-13.8 MPa.

19. The apparatus of claim 1, wherein the pumping means comprises an acid pump.

* * * * *